US007371113B2

(12) United States Patent
Burris et al.

(10) Patent No.: US 7,371,113 B2
(45) Date of Patent: May 13, 2008

(54) COAXIAL CABLE CONNECTOR WITH CLAMPING INSERT

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/639,451

(22) Filed: Dec. 15, 2006

(65) Prior Publication Data

US 2007/0155232 A1 Jul. 5, 2007

Related U.S. Application Data

(60) Provisional application No. 60/755,262, filed on Dec. 29, 2005.

(51) Int. Cl.
*H01R 9/05* (2006.01)

(52) U.S. Cl. ..... 439/578; 439/584

(58) Field of Classification Search ..... 439/584, 439/578, 585

See application file for complete search history.

(56) References Cited

U.S. PATENT DOCUMENTS

| | | | | |
|---|---|---|---|---|
| 4,400,050 | A | 8/1983 | Hayward | 339/177 R |
| 4,575,274 | A | 3/1986 | Hayward | 403/2 |
| 4,755,152 | A | 7/1988 | Elliot et al. | 439/452 |
| 4,834,675 | A | 5/1989 | Samchisen | 439/578 |
| 4,921,447 | A * | 5/1990 | Capp et al. | 439/585 |
| 5,181,861 | A * | 1/1993 | Gaver et al. | 439/578 |
| 5,470,257 | A | 11/1995 | Szegda | 439/578 |
| 5,879,191 | A | 3/1999 | Burris | 439/584 |
| 5,975,951 | A | 11/1999 | Burris et al. | 439/585 |
| 6,089,913 | A | 7/2000 | Holliday | 439/584 |
| 6,153,830 | A | 11/2000 | Montena | 174/88 C |
| 6,530,807 | B2 * | 3/2003 | Rodrigues et al. | 439/578 |
| 6,769,933 | B2 | 8/2004 | Bence et al. | 439/578 |
| 6,790,083 | B1 * | 9/2004 | Chen | 439/583 |
| 6,817,896 | B2 * | 11/2004 | Derenthal | 439/578 |
| 6,908,337 | B1 * | 6/2005 | Li | 439/578 |
| 7,008,263 | B2 * | 3/2006 | Holland | 439/578 |
| 7,018,235 | B1 | 3/2006 | Burris et al. | 439/584 |
| 7,112,093 | B1 * | 9/2006 | Holland | 439/585 |
| 2006/0128217 | A1 | 6/2006 | Burris | 439/584 |

* cited by examiner

*Primary Examiner*—Hae Moon Hyeon
(74) *Attorney, Agent, or Firm*—Joseph M. Homa; Matthew J. Mason

(57) ABSTRACT

A connector for coaxial cable is disclosed herein that has an outer body and a clamp insert. The clamp insert is mounted at the rear of the body and accepts an end of a coaxial cable. Both the front and rear ends of the insert are deformed radially inwardly when the body and the insert and compressed so as to grip the coaxial cable and form a seal. A related method for connecting the coaxial cable and connector is also disclosed.

17 Claims, 12 Drawing Sheets

COAXIAL CABLE CONNECTOR WITH CLAMPING INSERT

This application claims the benefit of priority under 35 U.S.C. § 119(e) of U.S. Provisional Application Ser. No. 60/755,262 filed on Dec. 29, 2005.

BACKGROUND OF THE INVENTION

1. Field of the Invention

The present invention relates generally to coaxial cable connectors.

2. Technical Background

Coaxial cable connectors such as F-connectors are used to attach a coaxial cable to another object such as an appliance or device or junction having a terminal adapted to engage the connector. Coaxial cable F-connectors are often used to terminate a drop cable in a cable television system. The coaxial cable typically includes a center conductor surrounded by a dielectric, in turn surrounded by a conductive grounding foil and/or braided shield, hereinafter collectively referred to as the outer conductor; the outer conductor is in turn surrounded by a protective outer jacket. The F-connector is secured over a prepared end of a jacketed coaxial cable, allowing the end of the coaxial cable to be connected with a terminal block, such as by a threaded connection with a threaded terminal of a terminal block, or with an adapter such as a female adapter that accepts the center conductor of the cable and has threads for threaded connection with the F-connector.

Crimp style F-connectors are known wherein a crimp sleeve is included as part of the connector body. A special radial crimping tool, having jaws that form a hexagon, is used to radially crimp the crimp sleeve around the outer jacket of the coaxial cable to secure such a crimp style F-connector over the prepared end of the coaxial cable. An example of such crimp connectors is disclosed within U.S. Pat. No. 4,400,050 to Hayward.

It is known in the art that the passage of moisture between the coaxial cable jacket and the surrounding F-connector can lead to corrosion, increased contact resistance, reduced signal strength, and excessive RF leakage from the connector. Various efforts have been made to form a seal between the F-connector and the jacket of the coaxial cable to preclude such moisture ingress. F-connectors are known in the cable television industry which utilize special sealing compounds in an effort to form leakproof seals. For example, U.S. Pat. No. 4,755,152 to Elliot, et al., discloses a crimp connector incorporating a glob of a gel or other movable sealing material within a cavity of the connector to form a seal between the jacket of the coaxial cable and the interior of the F-connector.

Still another form of F-connector is known wherein an annular compression sleeve is used to secure the F-connector over the prepared end of the cable. Rather than crimping a crimp sleeve radially toward the jacket of the coaxial cable, these F-connectors employ an annular compression sleeve that is initially attached to the F-connector, but which is detached therefrom prior to installation of the F-connector. The compression sleeve includes an inner bore for allowing such compression sleeve to be passed over the end of the coaxial cable prior to installation of the F-connector. The F-connector itself is then inserted over the prepared end of the coaxial cable. Next, the compression sleeve is compressed axially along the longitudinal axis of the connector into the body of the connector, simultaneously compressing the jacket of the coaxial cable between the compression sleeve and the tubular post of the connector. An example of such a compression sleeve F-connector is shown in U.S. Pat. No. 4,834,675 to Samchisen which discloses a compression sleeve type F-connector known in the industry as "Snap-n-Seal". A number of commercial tool manufacturers provide compression tools for axially compressing the compression sleeve into such connectors.

Another known connector is the radial compression-type F-connector such as disclosed in U.S. Pat. No. 5,470,257 to Szegda. A tubular locking member protrudes axially into the open rear end of the outer collar or sleeve. The tubular locking member is displaceable axially within the outer collar between an open position accommodating insertion of the tubular post into the prepared end of the coaxial cable, and a clamped position fixing the end of the cable within the F-connector. An O-ring is mounted on the rear end of the tubular locking member to seal the connection between the tubular locking member and the outer collar as the tubular locking member is axially compressed. Such connectors have been sold in the past under the designation "CMP". The O-ring provided on the tubular locking member is exposed and unprotected prior to axial compression of the F-connector.

Known coaxial cable connectors employ collars or sleeves which can be compressed inwardly against the outer surface of a coaxial cable to secure a coaxial cable connector thereto. For example, a connector assembly for a signal transmission system is disclosed in U.S. Pat. No. 4,575,274 to Hayward wherein a body portion threadedly engages a nut portion. The nut portion includes an internal bore in which a ferrule is disposed, the ferrule having an internal bore through which the outer conductor of a coaxial cable is passed. As the nut portion is threaded over the body portion, the ferrule is wedged inwardly to constrict the inner diameter of the ferrule, thereby tightening the ferrule about the outer surface of the cable. However, such connectors can not be installed quickly, as by a simple crimp or compression tool, but instead mating threads of such connector must be tightened, as by using a pair of wrenches.

SUMMARY OF THE INVENTION

Disclosed herein is a connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield. The connector comprises: a deformable clamp insert comprising a rear end, a front end, and an internal surface extending between the rear and front ends of the body, the internal surface defining a longitudinal hole; a hollow body comprising a rear end, a front end surrounding at least a portion of the clamp insert, and an inner surface defining a longitudinal hole extending between the rear and front ends of the hollow body, wherein the clamp insert is axially moveable within the hollow body between a rearward position and a forward position; a tubular post disposed at least partially within the longitudinal hole of the hollow body, the tubular post having a rear end, an inner surface and an outer surface, and wherein the outer surface of the tubular post and the internal surface of the insert define an annular cavity therebetween; wherein, in the rearward position, the rear end of the insert has a rear inner diameter, and the front end of the insert has a front inner diameter, and the insert has a rear portion with a rearward outer diameter; wherein the longitudinal hole at the rear end of the outer body has a rear body inner diameter smaller than the rearward outer diameter; wherein, in the forward position, the front end and rear end of the body are deformed radially inwardly, wherein at least part of the rear portion is disposed within the longitudinal hole of the body. The connector preferably further comprises a coupler disposed proximate the front end of the body.

In the forward position, the rear end of the insert has a reduced rear inner diameter less than the rear inner diameter in the rearward position.

In the forward position, the front end of the insert has a reduced front inner diameter less than the front inner diameter in the rearward position.

Preferably, the insert is circumferentially continuous.

In some embodiments, at least a portion of the insert surrounds at least a portion of the tubular post in the forward position.

In some embodiments, the inner surface of the body comprises a rearward facing tapered portion, and wherein the front end of the insert contacts the rearward facing tapered portion in the forward position.

In some embodiments, the rear portion of the insert further comprises an outer surface comprising a forward facing tapered portion having the rearward outer diameter.

Also disclosed herein is a combination of a coaxial cable and a connector for coupling an end of the coaxial cable to a terminal, the coaxial cable comprising an inner conductor, a dielectric surrounding the inner conductor, an outer conductor surrounding the dielectric, a braided shield surrounding the outer conductor, and a jacket surrounding the braided shield, the connector comprising: a deformable clamp insert comprising a rear end, a front end, and an internal surface extending between the rear and front ends of the body, the internal surface defining a longitudinal hole, wherein the end of the cable is disposed within the longitudinal hole; a hollow body comprising a rear end, a front end surrounding at least a portion of the clamp insert, and an inner surface defining a longitudinal hole extending between the rear and front ends of the hollow body, wherein the clamp insert is axially moveable within the hollow body between a rearward position and a forward position; a tubular post disposed at least partially within the longitudinal hole of the hollow body, the tubular post having a rear end, an inner surface and an outer surface, and wherein the outer surface of the tubular post and the internal surface of the insert define an annular cavity therebetween, wherein at least part of the tubular post is disposed between the outer conductor and the braided shield of the cable; wherein, in the rearward position, the rear end of the insert has a rear inner diameter, and the front end of the insert has a front inner diameter, and the insert has a rear portion with a rearward outer diameter; wherein the longitudinal hole at the rear end of the outer body has a rear body inner diameter smaller than the rearward outer diameter; wherein, in the forward position, the front end and rear end of the body are deformed radially inwardly, wherein at least part of the rear portion is disposed within the longitudinal hole of the body, thereby causing the rear end of the insert to contact and compress the jacket of the cable, and thereby sandwiching the jacket and/or the braided shield between the post and the front end of the insert.

Preferably, in the forward position, the rear end of the insert forms a 360° continuous seal around the jacket of the cable.

In some embodiments, the braided shield is folded back over the jacket of the cable and the front end of the insert directly contacts the braided shield in the forward position.

In some embodiments, the post further comprises a raised portion. The jacket and/or braided shield can be sandwiched between the front end of the insert and the raised portion of the post in the forward position, for example in order to improve pull strength.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
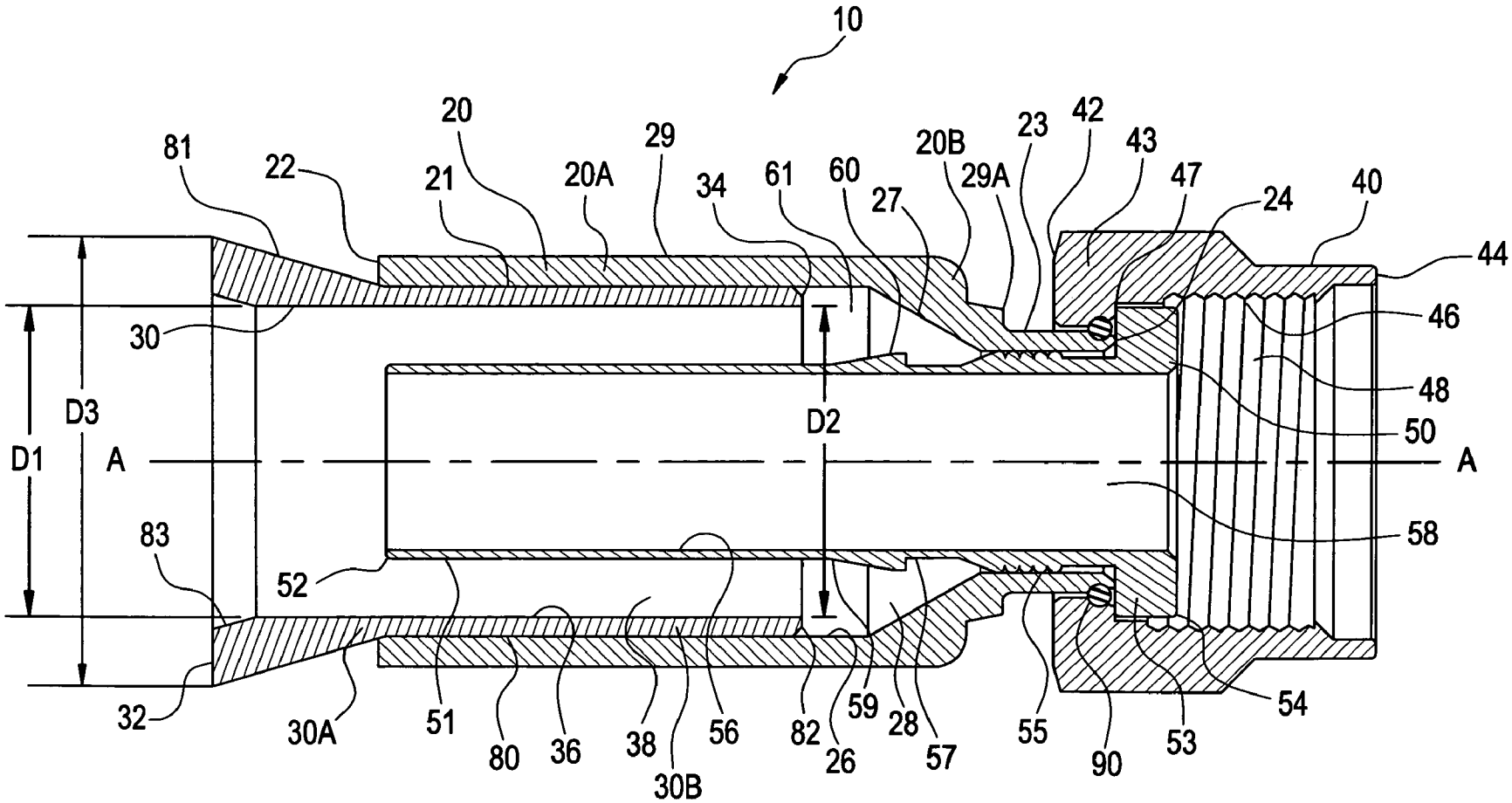
FIG. 1 is a side cutaway view along the centerline of a first embodiment of a connector as disclosed herein, comprising a clamping insert in a rearward position.

Reference will now be made in detail to the present preferred embodiment(s) of the invention, examples of which are illustrated in the accompanying drawings. Whenever possible, the same reference numerals will be used throughout the drawings to refer to the same or like parts.

Figure 2:
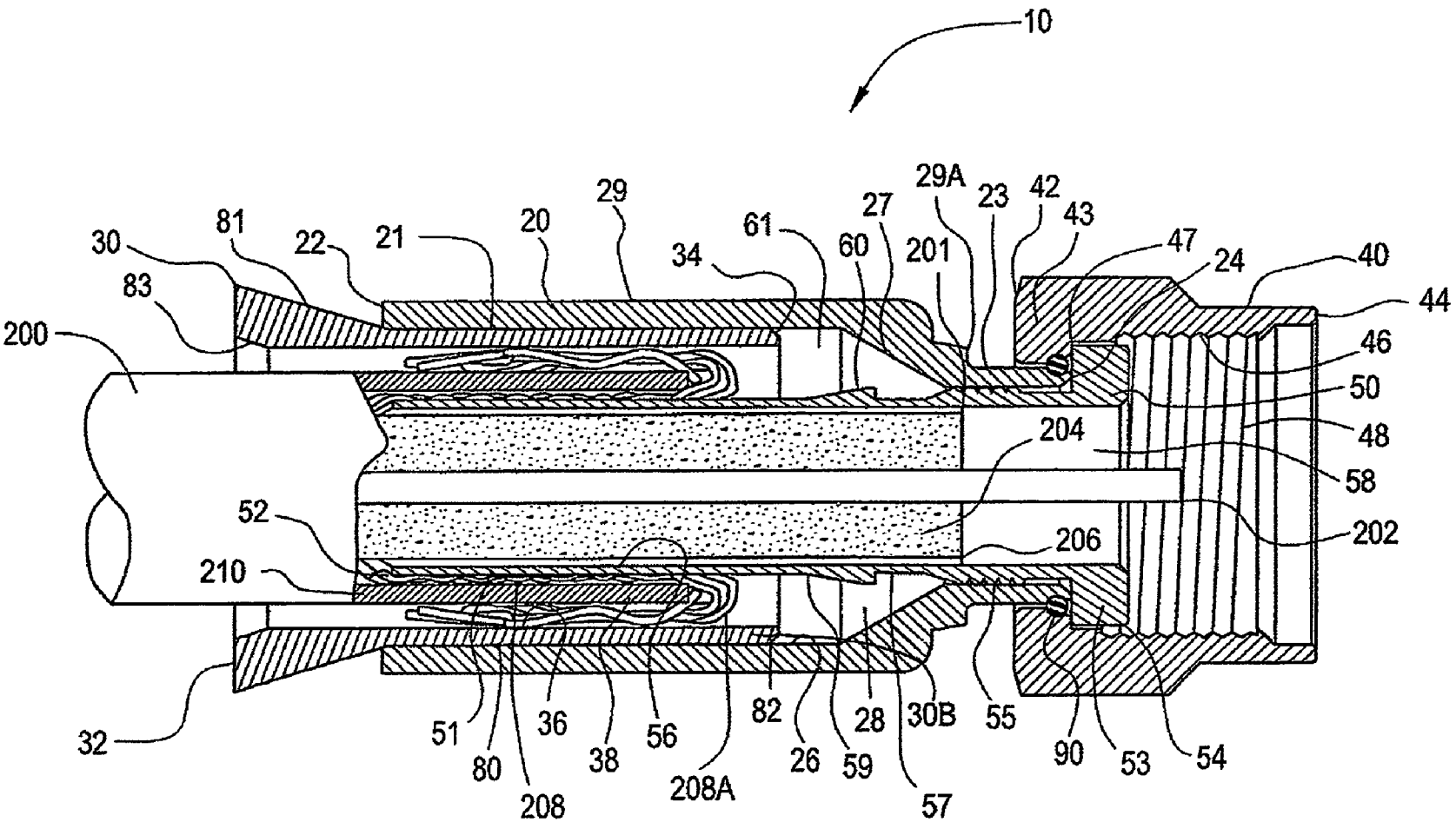
FIG. 2 is a side cutaway view of the connector of FIG. 1 with a coaxial cable, shown in partial side cutaway view, partially inserted into the connector.
Figure 3:
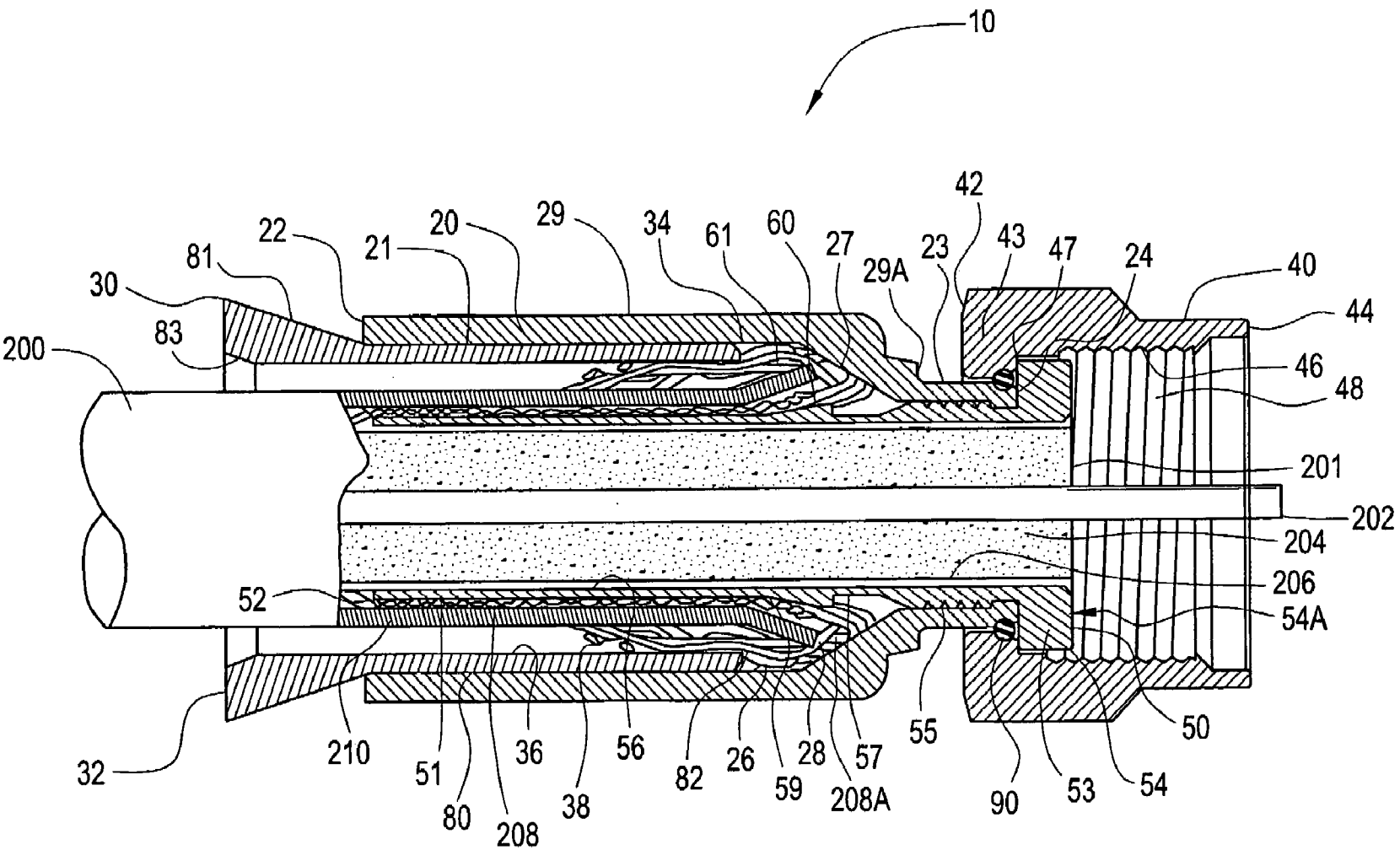
FIG. 3 is a side cutaway view of the connector of FIG. 1 with a coaxial cable, shown in partial side cutaway view, fully inserted into the connector.
Figure 4:
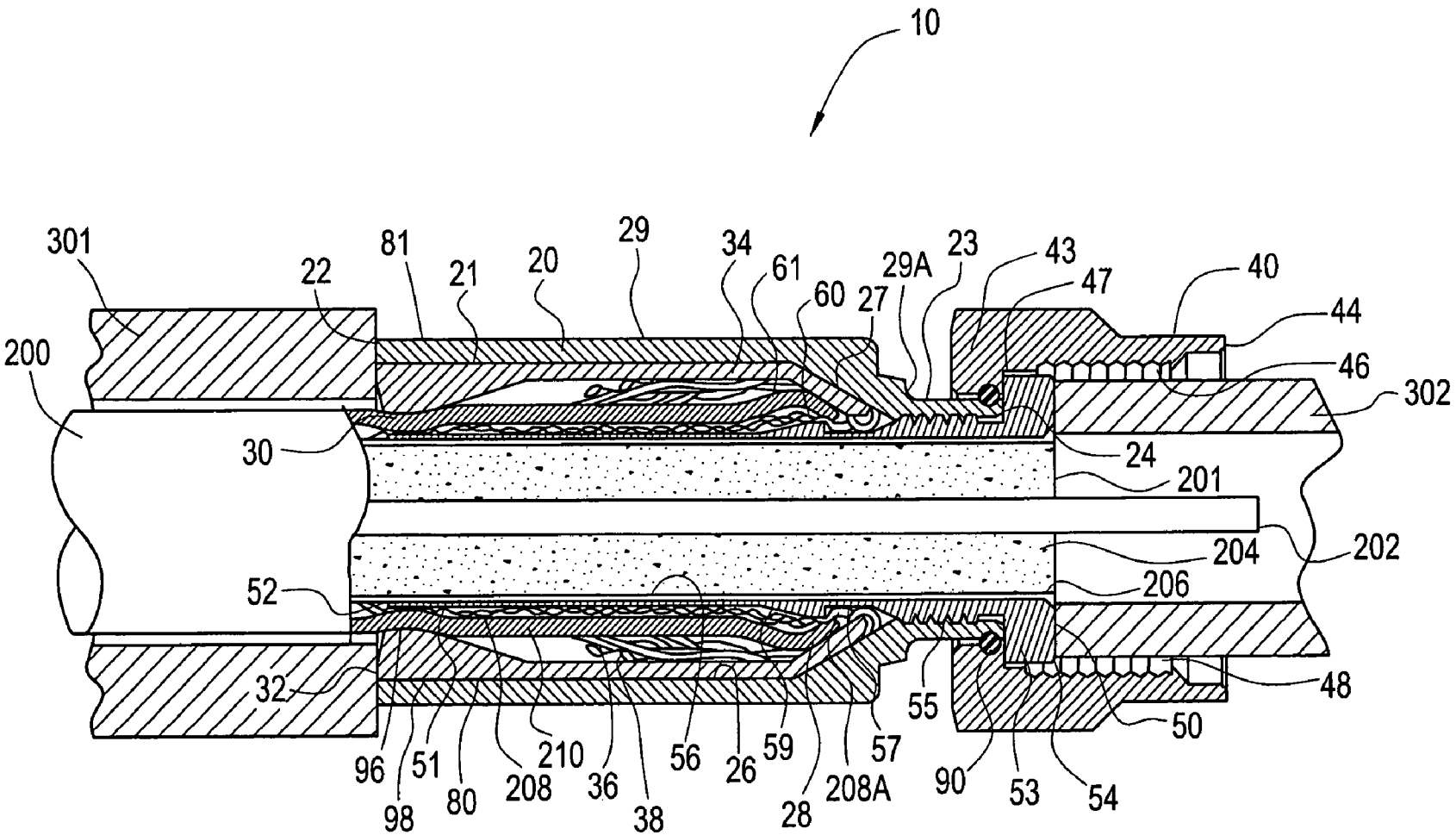
FIG. 4 is a side cutaway view of the connector of FIG. 1 with a partial view of a tool used to compress the connector such that the clamping insert is in a forward position.
Figure 5:
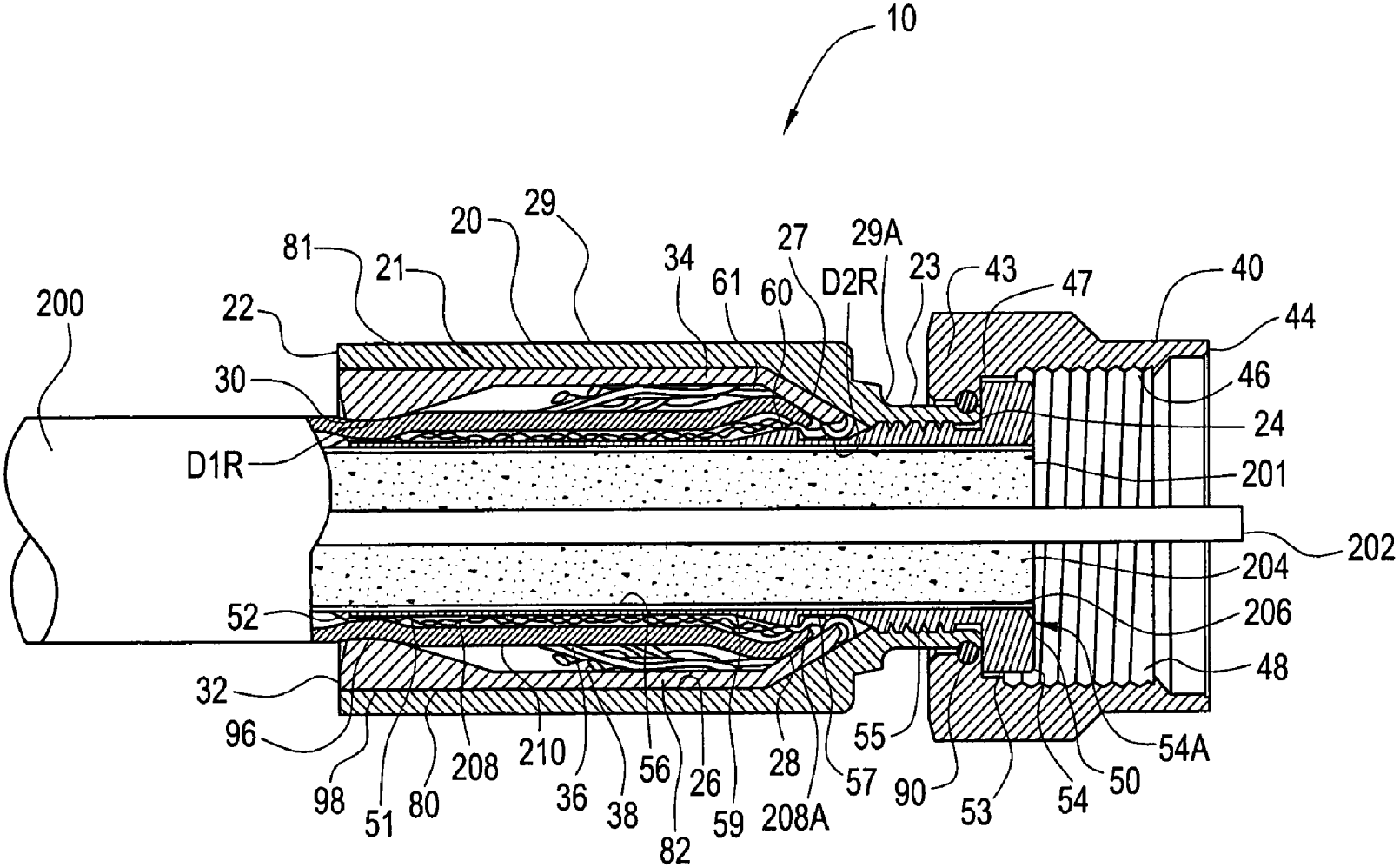
FIG. 5 is a side cutaway view of the connector and cable of FIG. 6 after the tool has been removed and the clamping insert is in the forward position.
Figure 6:
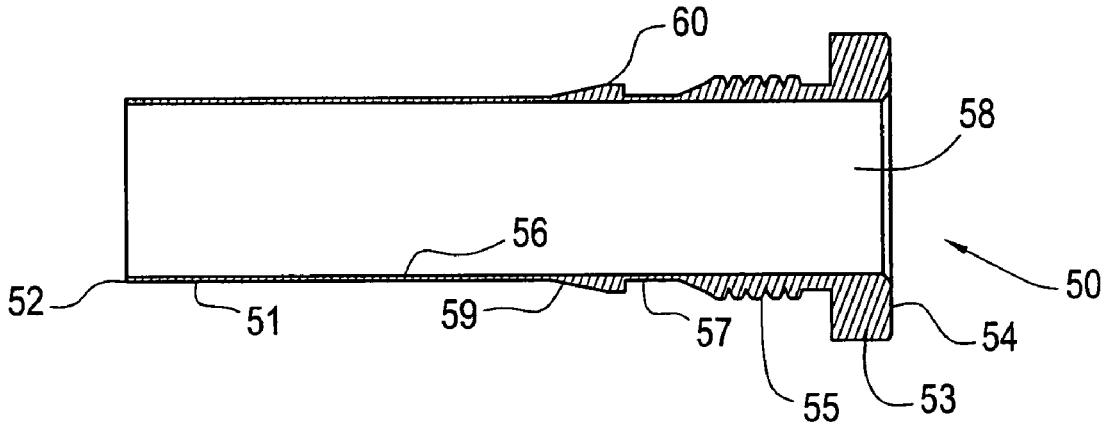
FIG. 6 is a side cutaway view of the post of the connectors of FIGS. 1-5.
Figure 7:
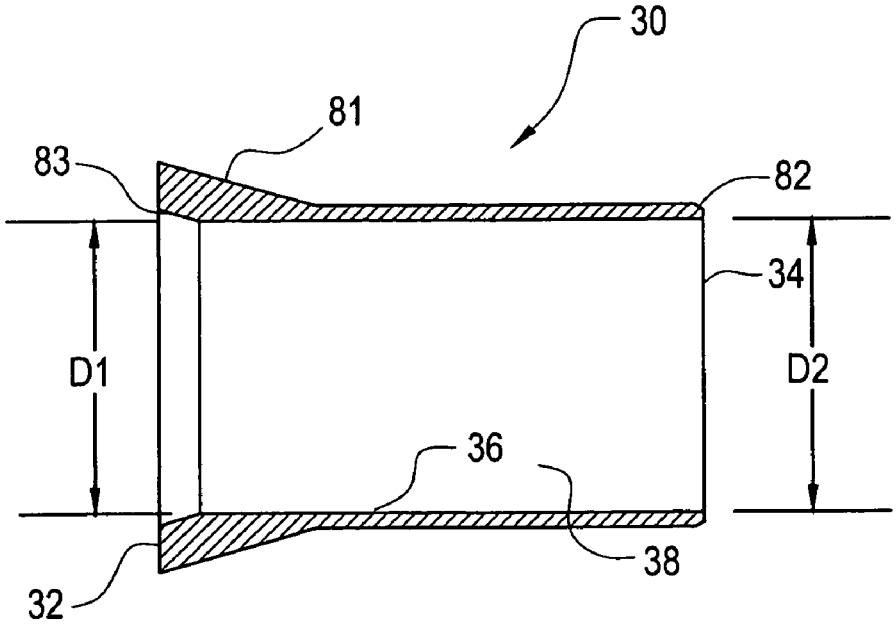
FIG. 7 is a side cutaway view of the clamping insert of FIG. 2.
Figure 8:
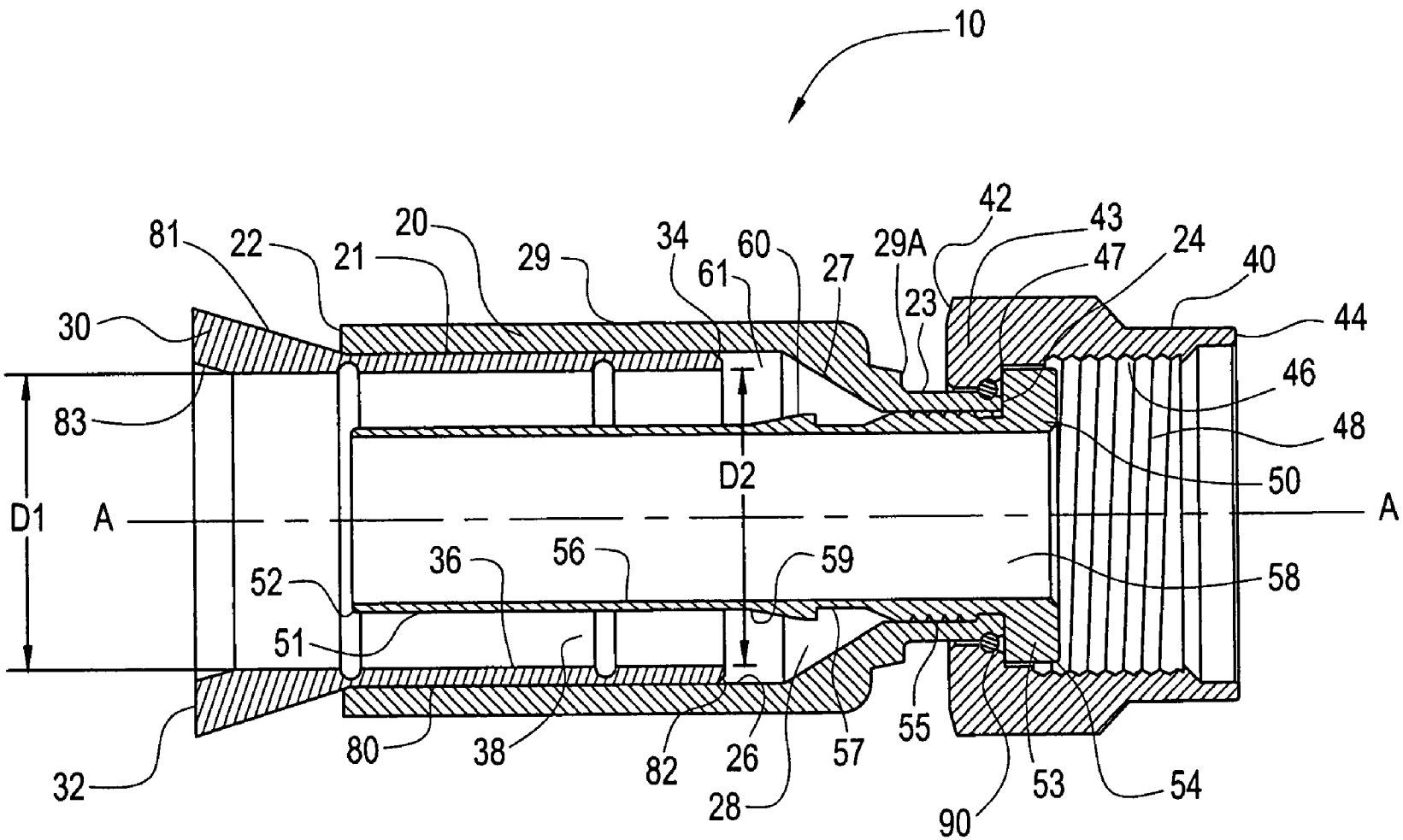
FIG. 8 is a side cutaway view along the centerline of a second embodiment of a connector as disclosed herein, comprising a clamping insert in a rearward position.
Figure 9:
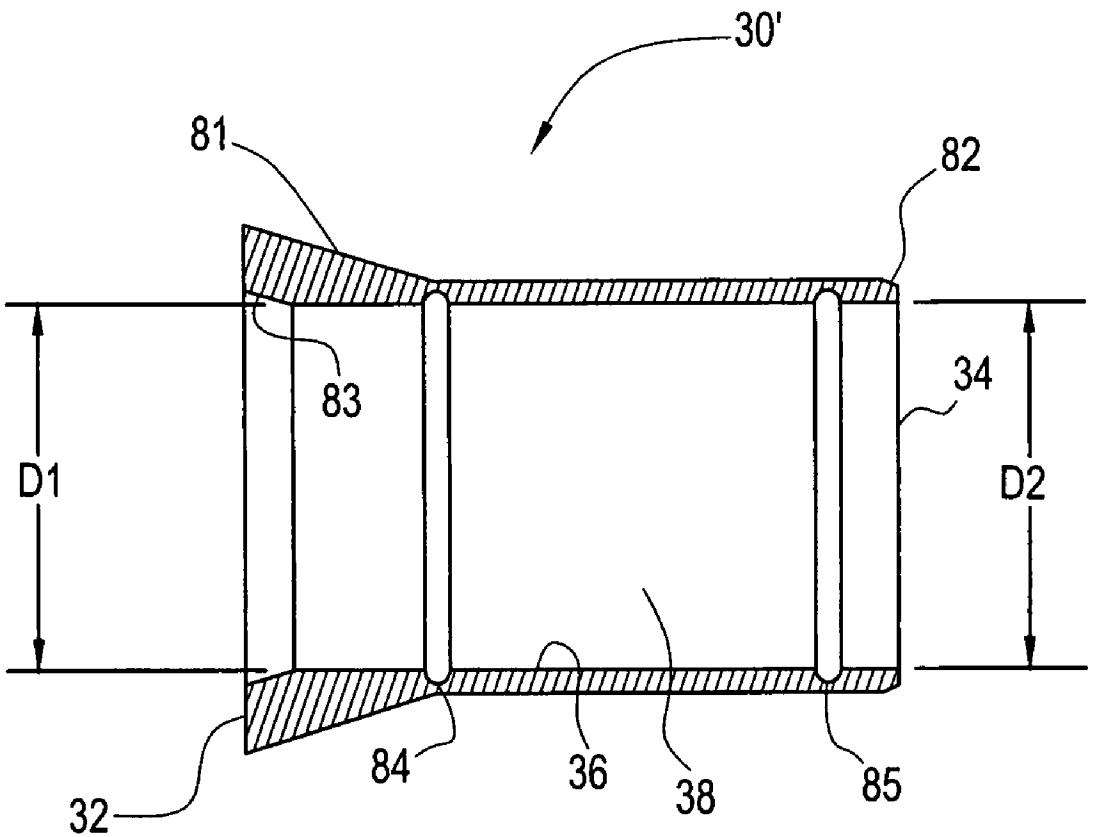
FIG. 9 is a side cutaway view of the clamping insert of FIG. 3.
Figure 10:
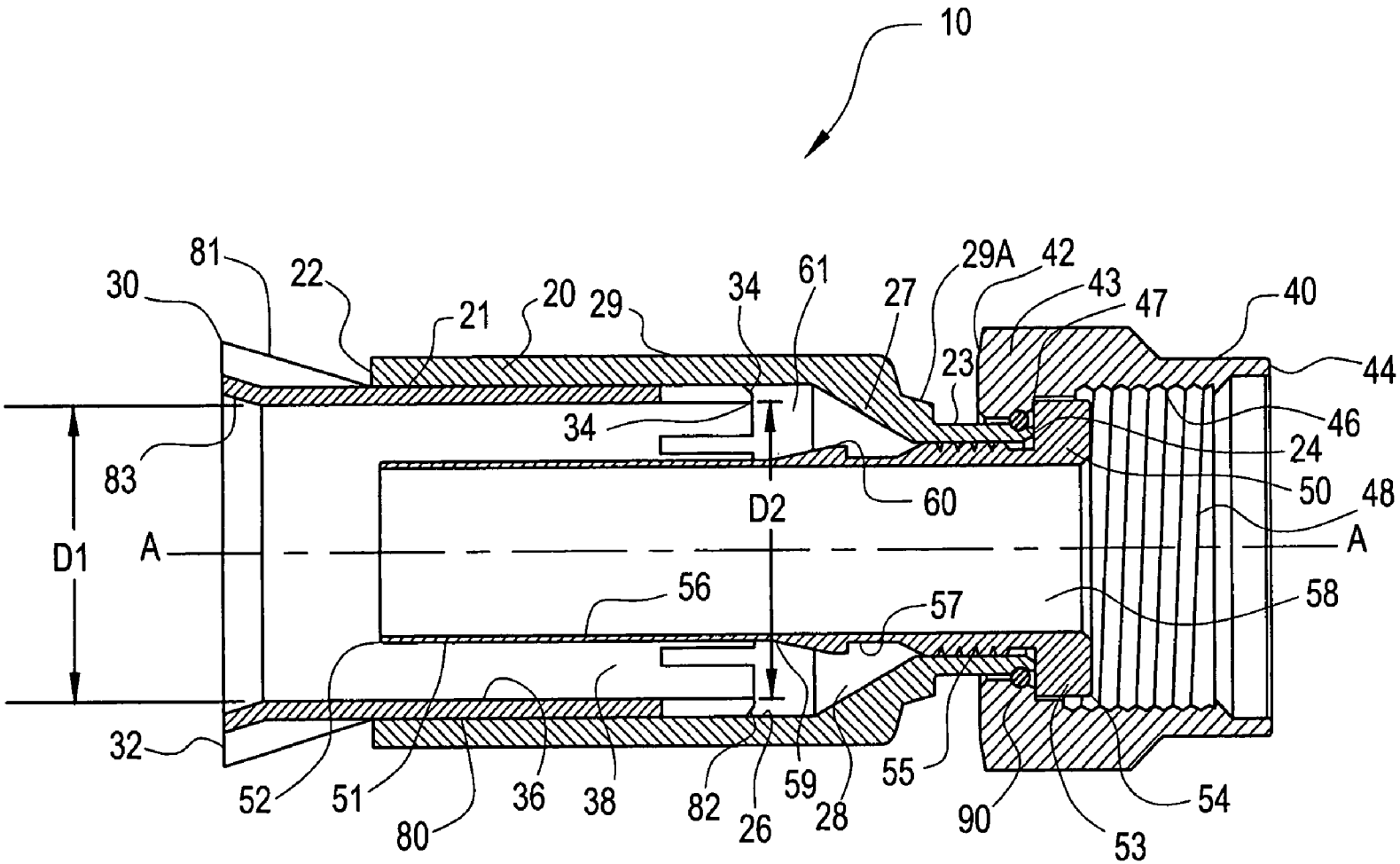
FIG. 10 is a side cutaway view along the centerline of a third embodiment of a connector as disclosed herein, comprising a clamping insert in a rearward position.
Figure 11:
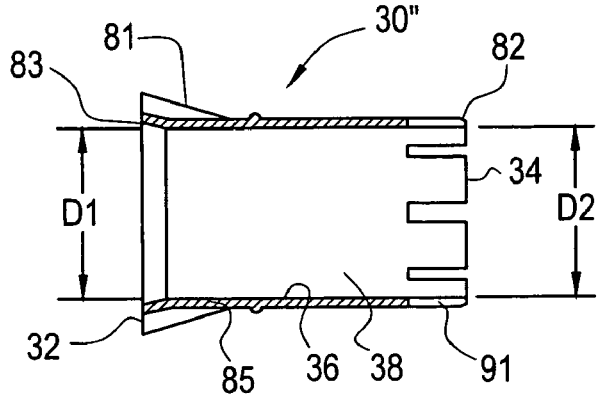
FIG. 11 is a side cutaway view of the clamping insert of FIG. 3 in an uncompressed state.
Figure 14:
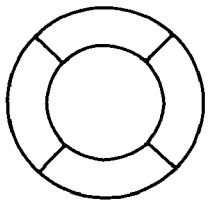
FIG. 14 is an end view of the clamping insert of FIG. 3 shown in a compressed state.
Figure 15:
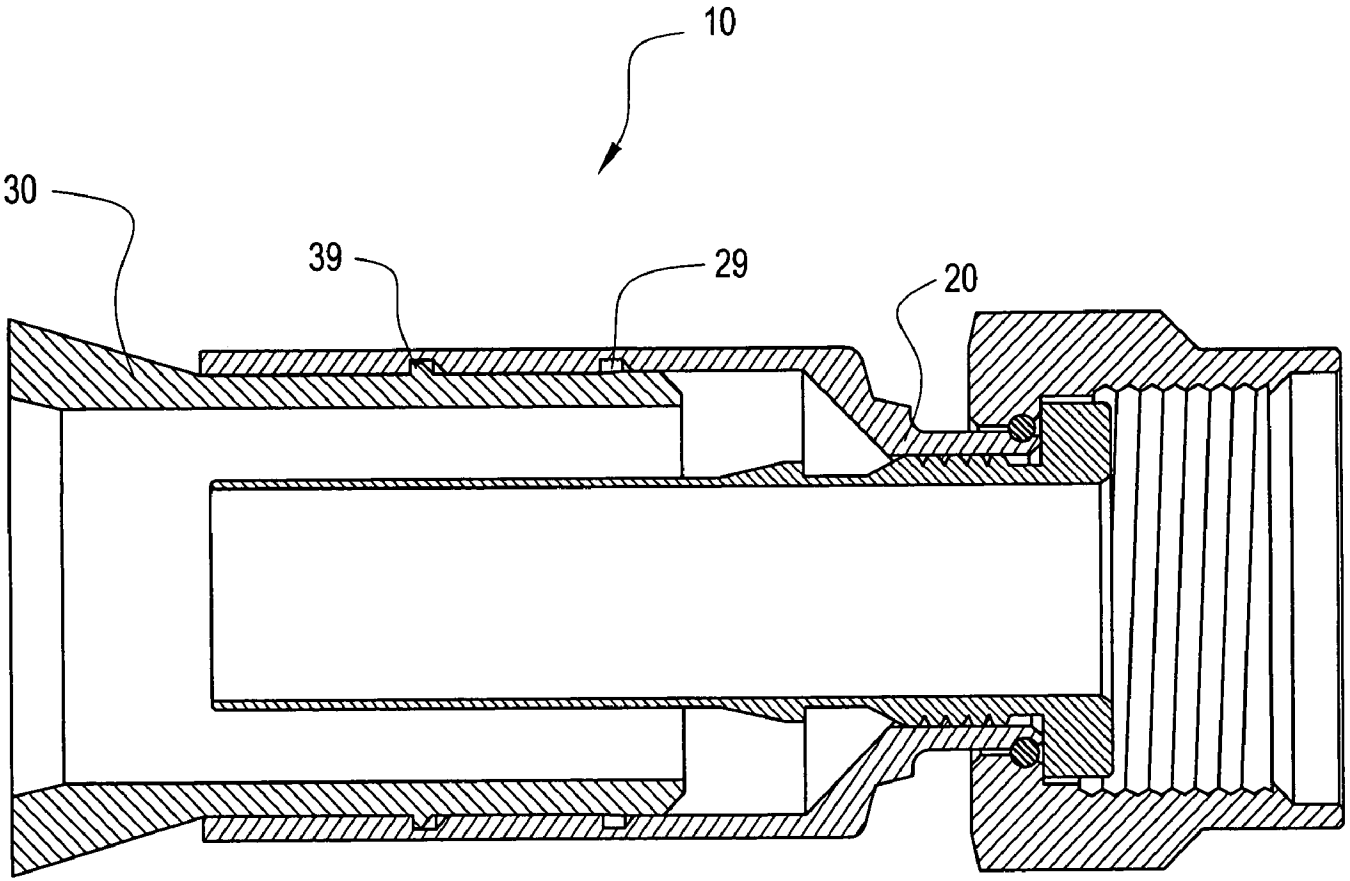
FIG. 15 is a side cutaway view along the centerline of a fourth embodiment of a connector as disclosed herein, comprising a clamping insert in a rearward position, the clamping insert comprising a means of retaining the clamping insert within the connector body, wherein the connector is shown in an open state.
Figure 16:
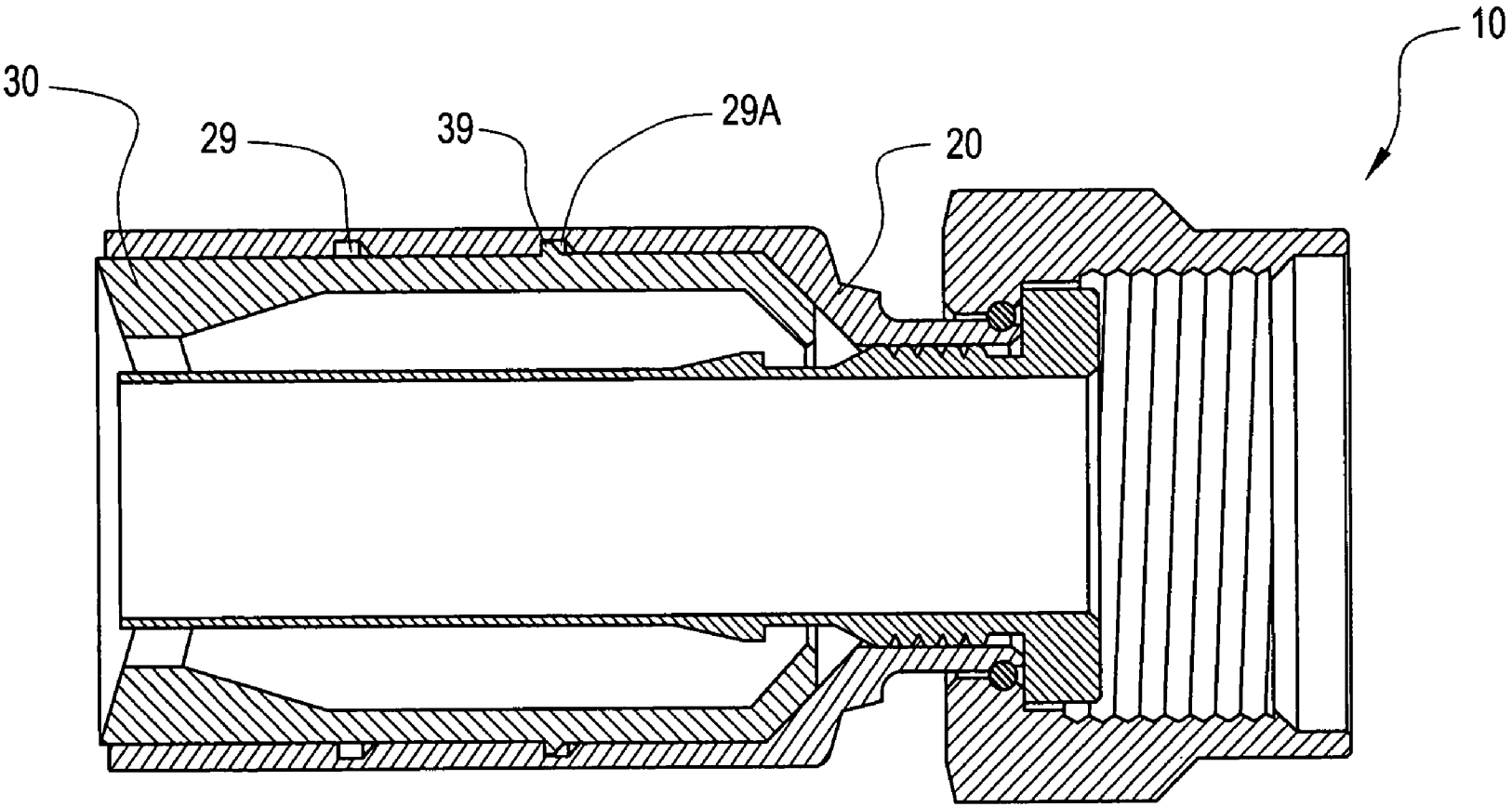
FIG. 16 is a side cutaway view of the connector of FIG. 12 shown in a closed state.

FIG. 1 schematically illustrates a first embodiment of a connector as disclosed herein, comprising a clamping insert in a rearward position. FIG. 8 schematically illustrates a second embodiment of a connector as disclosed herein, comprising a clamping insert in a rearward position. FIG. 10 schematically illustrates a third embodiment of a connector as disclosed herein, comprising a clamping insert in a rearward position. FIG. 2 schematically illustrates a coaxial cable partially inserted into the connector of FIG. 1, or, alternatively, the connector partially inserted onto the cable. FIG. 3 schematically illustrates the connector of FIG. 1 with a coaxial cable fully inserted into the connector or, alternatively, the connector fully inserted onto the cable. FIG. 4 schematically illustrates the connector of FIG. 1 and a coaxial cable and a tool used to compress the connector. FIG. 5 schematically illustrates the connector and cable of FIG. 4 after the tool has been removed and the clamping insert is in the forward position. FIG. 6 schematically illustrates the post of the connectors of FIGS. 1-5, 8, 10, and 15. FIGS. 9 and 11 schematically illustrate the clamping inserts of FIGS. 8 and 10, respectively. FIGS. 11-14 schematically illustrate the clamping insert of FIG. 10. FIG. 15 schematically illustrates a fourth embodiment of a connector as disclosed herein, comprising a clamping insert in a rearward position, the clamping insert comprising a means of retaining the clamping insert within the connector body, wherein the connector is shown in an open state. FIG. 16 schematically illustrates the connector of FIG. 15 shown in a closed state.

The connectors disclosed herein have a central longitudinal axis A-A, for example as illustrated in FIG. 1. Referring to FIGS. 2-5, the connectors disclosed herein are used for coupling an end of a coaxial cable 200 to a terminal, such as on an appliance or other device such as an adapter. The coaxial cable 200 shown in FIGS. 2-5 comprises an inner conductor 202, a dielectric layer (or, simply, dielectric) 204 surrounding the inner conductor 202, an outer conductor 206 surrounding the dielectric 204, a braided shield 208 surrounding the outer conductor 206, and a jacket 210 surrounding the braided shield 208.

Referring to FIG. 1, the connector 10 comprises a hollow body 20, a deformable clamping insert 30 disposed toward the rear end 22 of the body 20, a coupler 40 disposed at or near the front end 24 of the body 20, and a tubular post 50 disposed at least partially within the hollow body 20. Clamping insert 30 is comprised of a deformable material, such as plastic, for example acetal, or such as soft metal or alloy, for example lead. Preferably, body 20, and coupler 40 are made from a corrosion resistant material, for example nickel plated brass. Post 50 is made from electrically conductive material, preferably metal, for example tin-plated brass.

The hollow body 20 comprises a rear portion 20A comprising the rear end 22, a front portion 20B comprising the front end 24, and an internal surface 26 extending between the rear and front ends 22, 24 of the body 20, the internal surface 26 defining a longitudinal hole 28. The body 20 is generally tubular.

The clamping insert 30 comprises a rear portion 30A comprising a rear end 32, a front portion 30B comprising a front end 34 surrounded by the hollow body 20, and an inner surface 36 defining a longitudinal hole 38 extending between the rear and front ends 32, 34 of the clamping insert 30. The clamping insert 30 is generally tubular. In some embodiments, the front end 34 contacts the hollow body 20. In some embodiments, the front portion 30B of clamping insert 30 comprises a forward facing tapered section 82 at or proximate the front end 34. In some embodiments, the rear portion 30A of clamping insert 30 comprises a forward facing tapered section 81. In some embodiments, the rear end 32 of clamping insert 30 comprises a chamfer 83.

The internal surface 26 of hollow body 20 comprises a rearward facing tapered portion 27.

The tubular post 50 is disposed at least partially within the longitudinal hole 28 of the hollow body 20. The post 50 comprises an outer surface 57 and an inner surface 56, a head flange 53 and a tubular shank 51 extending rearwardly from head flange 53. The tubular shank 51 comprises a rear end 52, an inner surface 56 and an outer surface 57, wherein at least the rear end 52 is disposed within the longitudinal hole 28 of the body 20, and wherein the outer surface 57 of the tubular shank 51 and the internal surface 26 of the body 20 define an annular cavity 61 therebetween. The inner surface 56 defines a longitudinal hole 58 extending from the rear end 52 to the front end 54.

In some embodiments, the post 50 comprises a raised ridge 60 or optionally, a plurality of raised ridges, located intermediate the rear end 52 and the front end 54. In other embodiments, a raised ridge 60 or plurality of raised ridges is spaced away from the rear end 52 and surrounded by the front portion 20B of body 20. In FIG. 2, the raised ridge 60 is disposed longitudinally at or near the rearward facing tapered portion 27. A forward location (i.e. forward of the rear end 52 of shank 51) of the raised ridge 60 allows the cable 200 to be installed with less disruption to the cable braid 208 during installation because the rear end 52 can penetrate the cable for some length before the raised ridge engages the cable.

The clamping insert 30 is disposed between the hollow body 20 and the outer surface 57 of the post 50. The clamping insert 30 is axially moveable within the hollow body 20 between a rearward position, as depicted in the embodiments shown in FIGS. 1, 2, 3, 8, 10, and 15, and a forward position, as depicted in FIGS. 4, 5 and 16.

Referring to FIG. 1, in the rearward position, the inner surface 36 at the rear portion 30A of the clamping insert 30 has a rear inner diameter D1 and a rear outer diameter D3, and the inner surface 36 at the front portion 30B of the clamping insert 30 has a front inner diameter D2.

Referring to FIG. 5, in the forward position, the clamping insert 30 is compressed within the contours of the internal surface 26 of the hollow body 20. In the forward position, the rear end 32 of the clamping insert 30 has a reduced rear inner diameter D1R which is less than the rear inner diameter D1, and the front end 34 of the clamping insert 30 has a reduced front inner diameter D2R which is less than the front inner diameter D2. Both the rear and front ends 32, 34 of the clamping insert 30 are displaced radially inwardly in the forward position as compared to their configurations in the rearward position.

In some embodiments, the front inner diameter D2 and rear inner diameter D1 of the clamping insert 30 are substantially equal in the rearward position. In other embodiments, the front inner diameter D2 and the rear inner diameter D1 of the clamping insert 30 are not equal in the rearward position. In some embodiments, the clamping insert 30 has a substantially constant inner diameter in the rear portion 30A and front portion 30B in the rearward position. Preferably, the clamping insert 30 is concentrically disposed within body 20.

Clamping insert 30 is preferably mounted to the internal surface 26 of the body 20. In some embodiments, the rear end 32 of the clamping insert 30 is press fit with the inner surface 26 of the body 20, i.e. the clamping insert 30 is mounted onto the surface 26 of the body 20 by press fit. In other embodiments, the clamping insert 30 is mounted onto the inner surface 26 of the body 20 by shearable adhesive. In still other embodiments, the clamping insert 30 is not attached to the body 20, i.e. the clamping insert 30 is disposed loosely within the longitudinal hole 28 of the body 20. In yet other embodiments, the clamping insert is retained within the longitudinal hole 28 of the body 20 by means of one or more projections on the outer surface 80 of the clamping insert 30, such as outward projecting barbs or ribs 39 as illustrated in FIGS. 15 and 16, showing the outward projecting barbs or ribs 39 received in annular grooves 29 and 29A provided in the internal surface 26 of body 20, wherein the grooves 29 and 29A are spaced apart to accommodate barbs or ribs 39 in both the rearward and forward positions. The clamping insert 30 moves axially within the body 20 between the rearward and forward positions. As shown in FIG. 15, the outward projecting barbs or ribs 39 engage the groove 29 closest to the rear end 22 of the hollow body 20 to facilitate maintaining the rearward position of the clamping insert 30 relative to the body 20, for example during shipping and handling, before the connector is installed onto a cable. As shown in FIG. 16, in the forward position, the outward projecting barbs or ribs 39 engage the groove 29A closest to the front end 24 of the hollow body 20, thereby helping to retain the clamping insert 30 within the body 20 in the forward position, and thereby helping the connector to keep a grip on the cable.

The clamping insert 30 moves axially with respect to the post 50 between the rearward and forward positions.

The clamping insert 30 is preferably circumferentially continuous, i.e. 360 degrees continuous about a centerline axis, A-A. Although the clamping insert 30 is deformed in the forward position, the rear portion 30A of clamping insert 30 forms a continuous 360 degree seal at the rear end of the clamping insert 30 in the forward position. In the forward position, the inner surface 36 of the rear portion 30A of the clamping insert 30, preferably at or near the rear end 32, contacts the jacket 210 of the cable 200 and forms a seal with the cable. Preferably, in the forward position rear portion 30A of the clamping insert 30 forms a seal between the rear portion 20A of the hollow body 20 and the inner surface 36 of the clamping insert 30. Preferably, in the forward position, the inner surface 36 of the front portion 30B of the clamping insert 30, preferably at the front end 34, contacts the jacket 210 and/or braided shield 208 of the cable 200.

In the forward position the clamping insert 30 compresses the jacket 210 and braided shield 208 of the cable 200 driving them against the post 50. The jacket 210 and braided shield 208 are sandwiched between the front portion 30B of clamping insert 30 and post 50.

The front portion 20B of hollow body 20 comprises a tubular sleeve 21 having a front end 24 which forms the front end 24 of the body 20, wherein the front end 24 of the sleeve 21 preferably comprises a rearward facing tapered portion 27 configured to facilitate the displacement of the front end 34 of the clamping insert 30 radially inwardly. Preferably, the front end 34 of the clamping insert 30 is axially offset from the rearward facing tapered portion 27 in the rearward position, as shown in FIG. 1, to help provide more space to accommodate the folded back braid as the cable is inserted into the connector.

The outer surface 80 of the clamping insert 30 preferably comprises a forward facing tapered portion 82 configured to facilitate the displacement of the front end 34 of the clamping insert 30 radially inwardly when the front end 34 is driven against the rearward facing tapered portion 27 of the hollow body 20. Additionally, the outer surface 80 of the clamping insert 30 preferable comprises a forward facing tapered portion 81 configured to facilitate the displacement of the rear portion 30A of the clamping insert 30 radially inwardly when the clamping insert 30 and body 20 are driven together, for example clamping insert 30 is driven forward into body 20.

In some embodiments, the forward tapered portion 81 of the clamping insert 30 does not substantially contact the rear end 22 of the hollow body 20 in the rearward position. In other embodiments, the forward tapered portion 81 of the clamping insert 30 contacts the rear end 22 of the hollow body 20 in the rearward position. In the forward position, clamping insert 30 contacts the rear end 22 of hollow body 20 and displaces the rear end 32 of the clamping insert 30 radially inwardly in the forward position.

In the rearward position, the end 201 of the coaxial cable 200 is inserted into the connector 10 to the extent that at least part of the inner conductor 202 and at least part of the dielectric 204 are disposed within the tubular shank 51, and wherein at least part of the braided shield 208 and at least part of the jacket 210 are disposed in the annular cavity 61. Preferably, in the forward position, at least a portion of the jacket 210 and at least a portion of the braided shield 208 are sandwiched between the clamping insert 30 and the rear end 52 of the tubular shank 51. Preferably, in the forward position, the clamping insert 30 forms a seal between the jacket 210 and the rear end 32 of the clamping insert 30, thereby sealing the annular cavity 60 at or near the rear end 22 of the hollow body 20, as at 96 in FIG. 4. Preferably, in the forward position, the clamping insert 30 forms a seal between the jacket 210 and the inner surface 26 of the hollow body 20, as at 98 in FIG. 4.

Preferably, in the forward position, the front portion 30B of the clamping insert 30 forms a compressive ring between the rearward facing tapered portion 27 of the hollow body 20 and around the raised ridge 61 of the post 50 thereby sandwiching at least a portion of the jacket 210 and/or at least a portion of the braided shield 208.

In the forward position, the clamping insert 30 preferably simultaneously acts as a compressive member: (1) between the rear portion 20A of the hollow body 20 and the jacket 210, thereby sealing the annular cavity 60 at or near the rear end 22 of the hollow body 20; and (2) between tapered portion 27 of the hollow body 20 and folded back braid 208A and jacket 210 thereby capturing the cable 200 and forcing the cable into positive electrical and mechanical communication with the post 50.

In some embodiments, the outer surface 57 of the tubular post 50 at or near the rear end 52 thereof comprises a smooth diameter 51.

Preferably, the head flange 53 of the tubular post 50 is not disposed within the hollow body 20. Preferably, the front portion 20B of the hollow body 20 comprises a neck 23, wherein the front portion 20B of the hollow body 20 at the neck 23 is configured to axially engage the head flange 53 of the post 50, thereby preventing the head flange 53 from entering the longitudinal hole 28 of the hollow body 20.

Coupler 40 comprises a rear end 42, a front end 44 for engaging a terminal, an inner surface 46 defining a longitudinal hole 48 extending from the rear end 42 to the front end 44, such that at least a portion of the end of the cable can project into the longitudinal hole 48.

In some embodiments, the coupler 40 comprises an inner surface 46 which is at least partially threaded for threadedly engaging a threaded port, wherein the coupler 40 may be referred to as a nut. The rear end 42 of the coupler 40 comprises a tail flange 43 configured to surround at least a portion of the neck 23 of the body 20. The tail flange 43 comprises a forward facing portion 47 configured to axially engage the head flange 53 of the post 50, thereby preventing the coupler 40 from axially sliding off the front end 24 of the body 20. The outer surface 29 of the hollow body 20 preferably comprises an external shoulder 29*a* disposed rearward of the neck 23, wherein the shoulder 29*a* is configured to axially engage the rear end 42 of the coupler 40, thereby preventing the coupler 40 from axially sliding off the rear end 22 of the body 20. An O-ring 90 is preferably disposed between the neck 23, the head flange 53 of the post 50, and the tail flange 43 of the coupler 40. Prior to engaging the coupler 40 (and therefore the connector) to a terminal, the tail flange 43 is rotatably mounted around the neck 23, and preferably the coupler 40 is freely rotatable around the neck 23. Preferably, the tubular post 50 is fixedly attached to the hollow body 20; in some embodiments, the post 50 is attached to the body 20 by press fit, wherein the outer surface 57 of the post 50 is configured for press fit with the internal surface 26 of the hollow body 20 at the neck 23. In some embodiments, the outer surface 57 of the post 50 comprises a plurality of ridges 55 for engaging the internal surface 26 of the hollow body 20 at the neck 23. In other embodiments, the tubular post and the hollow body are formed as a single-piece unitary hollow body. As shown in FIG. 1, coupler 40 surrounds at least part of post 50 and/or at least part of body 20.

FIGS. 8-14 show other preferred embodiments of a connector disclosed herein wherein the clamping insert comprises various means of aiding and/or controlling deformation of the clamping insert 30 during connector compression.

Figure 12:
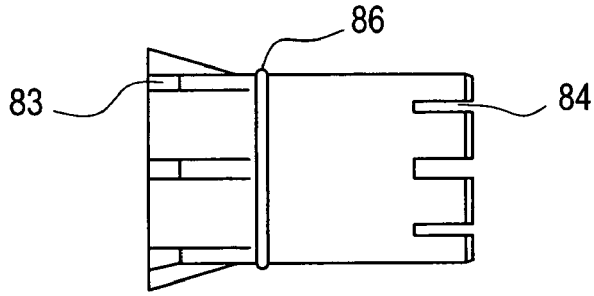
FIG. 12 is a side elevated view of the clamping insert of FIG. 11.
Figure 13:
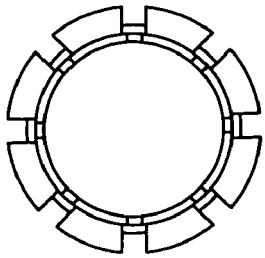
FIG. 13 is an end view of the clamping insert of FIG. 11.

FIG. 9 further illustrates the clamping insert 30' of FIG. 8. Internal grooves 84 and 85 aid and/or control deformation of the clamping insert 30'. Grooves 84 and 85 are selectively placed to weaken the clamping insert 30 at desired locations to promote bending at or near the grooves. FIGS. 11-14 further illustrate the clamping insert 30" of FIG. 3 comprising a rear end 32, a front end 34 surrounded by and contacting the hollow body 20, and an inner surface 36 defining a longitudinal hole 38 extending between the rear and front ends 32, 34, and a forward facing tapered section 82 proximate the front end 34, a forward facing tapered section 81 proximate the rear end 32 and a chamfer 83 proximate the rear end 32. A plurality of slots 83 proximate the rear and 32 provide a means to help the clamping insert to collapse radially inwardly during compression. In FIGS. 11 and 12, slots 83 proximate the rear end 32 do not traverse completely through the wall 85 and therefore help block a moisture path from the outside of the clamping insert to the inside of the clamping insert 30" at the rear end 32. Slots 83 are configured to close tightly upon compression as shown in FIG. 14. Clamping insert 30" can be press fit with the inner surface 26 of the body 20, i.e. the clamping insert 30 can be mounted onto the surface 26 of the body 20 by press fit. A raised annular rib 86 helps to provide an additional moisture block. An additional plurality of slots 84 proximate the front end 34 can be provided to collapse of the clamping insert 30" radially inwardly during compression.

In use, the end 201 of a coaxial cable 200 is brought together with the rear end of the connector 10, i.e. the rear end 32 of clamping insert 30, such that the cable 200 passes into the longitudinal hole 38 of the clamping insert 30 and is impaled upon the rear end 52 of the shank 51 of the tubular post 50. The rear end 52 of the shank 51 is driven between the braided shield 208 and the outer conductor 206 of the cable 200, preferably until the dielectric 204 at the end 201 of the cable 200 is flush with the distal surface 54*a* of the end 54 of the post 50, as illustrated in FIG. 5. Distortion of cable 200 is minimized by the low profile configuration of the rear end 52 of the shank 51 of the tubular post 50. Flaring of the braided shield 208 (and jacket 210) of the cable 200 is limited to the engaged length between the cable 200 and raised ridge 61 on the outer surface 57 of the tubular post 50.

The body 20 and the tubular post 50 are then moved axially together, such as by implementation of a tool having first and second driving members 301, 302 which engage the rear end 32 of the clamping insert 30 and the head 53 of the tubular post 50, respectively, as illustrated in FIG. 4. The compressive force generated by the first and second members 301, 302 axially moves the front end 34 of the clamping insert 30 into the sleeve 21 of the hollow body 20, preferably until the front end 34 of the clamping insert 30 engages the rearward facing tapered portion 27 of the hollow body 20, and such that the forward facing tapered portion 81 engages the rear end 22 of body 20, thereby deforming the clamping insert 30 such that the front and rear ends 34, 34 of the clamping insert 30 are deflected radially inwardly against the cable 200.

Preferably, the jacket 210 is simultaneously sandwiched between the clamping insert 30 and the rear end 52 of the shank 51 of the tubular post 50 and the tapered ridge 61. With the connector 10 attached to the end 201 of the cable 200, the connector 10 can then be placed into contact with a terminal such as a threaded terminal. The coupler 40 may be tightened onto the threaded terminal for electrical and mechanical coupling of the coaxial cable 200 to the terminal via the coaxial connector 10. As the coupler 40 is rotated to engage the threads of the coupler 40 and the terminal, O-ring 90 is compressed to form a seal.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A connector for coupling an end of a coaxial cable to a terminal, the coaxial cable comprising an inner conductor, a dielectric surrounding the inner conductor, an outer conductor surrounding the dielectric, a braided shield surrounding the dielectric, and a jacket surrounding the braided shield, the connector comprising:

a deformable clamp insert comprising a rear end, a front end, and an internal surface extending between the rear and front ends of the deformable clamp insert, the internal surface defining a longitudinal hole;

a hollow body comprising a rear end, a front end surrounding at least a portion of the deformable clamp insert, and an inner surface defining a longitudinal hole extending between the rear and front ends of the hollow body, wherein the deformable clamp insert is axially moveable within the hollow body between a rearward position and a forward position;

a tubular post disposed at least partially within the longitudinal hole of the hollow body, the tubular post having a rear end, an inner surface and an outer surface, and wherein the outer surface of the tubular post and the internal surface of the deformable clamp insert define an annular cavity therebetween;

wherein, in the rearward position, the rear end of the deformable clamp insert has a rear inner diameter, and the front end of the deformable clamp insert has a front inner diameter, and the deformable clamp insert has a rear portion with a rearward outer diameter;

wherein the longitudinal hole at the rear end of the hollow body has a rear body inner diameter smaller than the rearward outer diameter when the deformable clamp insert is in the rearward position;

wherein, in the forward position, the front end and rear end of the deformable clamp insert are deformed radially inwardly, wherein at least part of the rear portion is disposed within the longitudinal hole of the hollow body.

2. The connector of claim 1, further comprising a coupler disposed proximate the front end of the hollow body.

3. The connector of claim 1, wherein, in the forward position, the rear end of the deformable clamp insert has a reduced rear inner diameter less than the rear inner diameter in the rearward position.

4. The connector of claim 1, wherein, in the forward position, the front end of the deformable clamp insert has a reduced front inner diameter less than the front inner diameter in the rearward position.

5. The connector of claim 1, wherein the deformable clamp insert is circumferentially continuous.

6. The connector of claim 1, wherein at least a portion of the deformable clamp insert surrounds at least a portion of the tubular post in the forward position.

7. The connector of claim 1, wherein the inner surface of the hollow body comprises a rearward facing tapered portion, and wherein the front end of the deformable clamp insert contacts the rearward facing tapered portion in the forward position.

8. The connector of claim 1, wherein the rear portion of the deformable clamp insert further comprises an outer surface comprising a forward facing tapered portion having the rearward outer diameter.

9. The connector of claim 1, wherein the outer surface of the tubular post comprises a raised ridge.

10. The connector of claim 9, wherein the raised ridge is disposed forward of the rear end of the tubular post.

11. The combination of a coaxial cable and a connector for coupling an end of the coaxial cable to a terminal, the coaxial cable comprising an inner conductor, a dielectric surrounding the inner conductor, an outer conductor surrounding the dielectric, a braided shield surrounding the outer conductor, and a jacket surrounding the braided shield, the combination comprising:

a deformable clamp insert comprising a rear end, a front end, and an internal surface extending between the rear and front ends of the deformable clamp insert, the internal surface defining a longitudinal hole, wherein the end of the cable is disposed within the longitudinal hole;

a hollow body comprising a rear end, a front end surrounding at least a portion of the deformable clamp insert, and an inner surface defining a longitudinal hole extending between the rear and front ends of the hollow body, wherein the deformable clamp insert is axially moveable within the hollow body between a rearward position and a forward position; and a tubular post disposed at least partially within the longitudinal hole of the hollow body, the tubular post having a rear end, an inner surface and an outer surface, and wherein the outer surface of the tubular post and the internal surface of the deformable clamp insert define an annular cavity therebetween, wherein at least part of the tubular post is disposed between the outer conductor and the braided shield of the cable;

wherein, in the rearward position, the rear end of the deformable clamp insert has a rear inner diameter, and the front end of the deformable clamp insert has a front inner diameter, and the deformable clamp insert has a rear portion with a rearward outer diameter;

wherein the longitudinal hole at the rear end of the hollow body has a rear body inner diameter smaller than the rearward outer diameter when the deformable clamp insert is in the rearward position; and wherein, in the forward position, the front end and rear end of the deformable clamp insert are deformed radially inwardly, wherein at least part of the rear portion is disposed within the longitudinal hole of the hollow body, thereby causing the rear end of the deformable clamp insert to contact and compress the jacket of the cable, and thereby sandwiching the jacket and/or the braided shield between the post and the front end of the deformable clamp insert.

12. The combination of claim 11 wherein, in the forward position, the rear end of the deformable clamp insert forms a 360° continuous seal around the jacket of the cable.

13. The combination of claim 11 wherein the braided shield is folded back over the jacket of the cable and the front end of the deformable clamp insert directly contacts the braided shield in the forward position.

14. The combination of claim 11 wherein the post further comprises a raised portion.

15. The combination of claim 14 wherein the jacket and/or braided shield is sandwiched between the front end of the deformable clamp insert and the raised portion of the post in the forward position.

16. A coaxial cable and connector assembly for coupling to a terminal, the assembly comprising:

a coaxial cable comprising an inner conductor, a dielectric surrounding the inner conductor, an outer conductor surrounding the dielectric, a braided shield surrounding the outer conductor, and a jacket surrounding the braided shield; and a connector comprising:

a deformable clamp insert comprising a rear end, a front end, and an internal surface extending between the rear and front ends of the deformable clamp insert, the internal surface defining a longitudinal hole, wherein the end of the cable is disposed within the longitudinal hole;

a hollow body comprising a rear end, a front end surrounding at least a portion of the deformable clamp insert, and an inner surface defining a longitudinal hole extending between the rear and front ends of the hollow body, wherein the deformable clamp insert is axially moveable within the hollow body between a rearward position and a forward position; and a tubular post disposed at least partially within the longitudinal hole of the hollow body, the tubular post having a rear end, an inner surface and an outer surface, and wherein the outer surface of the tubular post and the internal surface of the deformable clamp insert define an annular cavity therebetween, wherein at least part of the tubular post is disposed between the outer conductor and the braided shield of the cable;

wherein, in the rearward position, the rear end of the deformable clamp insert has a rear inner diameter, and the front end of the deformable clamp insert has a front inner diameter, and the deformable clamp insert has a rear portion with a rearward outer diameter;

wherein the longitudinal hole at the rear end of the hollow body has a rear body inner diameter smaller than the rearward outer diameter when the deformable clamp insert is in the rearward position; and wherein, in the forward position, the front end and rear end of the deformable clamp insert are deformed radially inwardly, wherein at least part of the rear portion is disposed within the longitudinal hole of the hollow body, thereby causing the rear end of the deformable clamp insert to contact and compress the jacket of the cable, and thereby sandwiching the jacket and/or the braided shield between the post and the front end of the deformable clamp insert.

17. The assembly of claim 16 further comprising a coupler disposed proximate the front end of the hollow body.

* * * * *